United States Patent [19]

Howard-Leicester et al.

[11] 4,347,430

[45] Aug. 31, 1982

[54] VAPOR GENERATOR WITH CYCLING MONITORING OF CONDUCTIVITY

[75] Inventors: Michael Howard-Leicester, Edelweiss Valley, General Delivery, Wilson's Corner, Quebec; Siegbert Gundacker, Kars; Larry J. Moffatt, Ottawa, all of Canada

[73] Assignee: Michael Howard-Leicester, Quebec, Canada

[21] Appl. No.: 121,408

[22] Filed: Feb. 14, 1980

[51] Int. Cl.[3] ..... H05B 1/02; H05B 3/60

[52] U.S. Cl. ..... 219/295; 219/497; 219/285; 219/286; 122/382; 340/526

[58] Field of Search ..... 219/497, 494, 501, 518, 219/299, 285, 286, 287; 122/382, 504.2; 340/526

[56] References Cited

U.S. PATENT DOCUMENTS

| | | | |
|---|---|---|---|
| 3,007,024 | 10/1961 | Hensen | 219/519 X |
| 3,351,739 | 11/1967 | Eckman | 219/519 X |
| 3,489,882 | 1/1970 | Krackow | 219/486 |
| 3,780,261 | 12/1973 | Eaton-Williams | 219/295 |
| 3,937,920 | 2/1976 | Gundacker et al. | 219/286 |
| 3,944,785 | 3/1976 | Eaton-Williams | 219/295 |
| 4,146,775 | 3/1979 | Kirchner et al. | 219/295 |
| 4,196,341 | 4/1980 | Williams | 219/295 |

*Primary Examiner*—B. A. Reynolds
*Assistant Examiner*—M. H. Paschall
*Attorney, Agent, or Firm*—Wenderoth, Lind & Ponack

[57] ABSTRACT

A water vapor generator having electrodes in a vaporization vessel is disclosed. Current passed through the water between electrodes causes water in the vessel to heat and boil off as steam, make-up water being added when the current drops below a preset minimum value. The make-up water is cut off when a preset maximum value is reached. Thus, the generator operates through successive cycles each containing a descending "boil" leg and an ascending "fill" leg. As water is boiled, its mineral content becomes more and more concentrated, causing increasing its conductivity. To return the water conductivity to its design value the frequency of the boil/fill cycles is measured over several cycles and compared with a predetermined value. If the measured frequency is higher, this indicates a higher than desired water conductivity and a drain cycle is initiated by operating a drain valve. The amount of water drained out of the vessel is proportional to the deviation of frequency from the predetermined value. The frequency can be measured by the duration of a predetermined number of cycles and this is then compared with a predetermined duration corresponding to the predetermined frequency.

26 Claims, 9 Drawing Figures

CURRENT % CAPACITY
105
100
95
90
80
70
60
TIME
CD
A
B
C
D
E
F
G
H
0
1
2
3
4
5
6
7
8
9
10
20

WATER CONDUCTIVITY AND BOILING WATER LEVEL (ALL 100% CAPACITY)

VAPOR GENERATOR WITH CYCLING MONITORING OF CONDUCTIVITY

BACKGROUND OF THE INVENTION

This invention relates to humidifiers and more particularly to the electrode type steam generating humidifiers.

Such humidifiers in which a current is passed between spaced electrodes in a water-carrying vessel are well-known. The current causes heating of the water and subsequently generation of steam which is passed into the air space, the moisture content of which is to be controlled.

The magnitude of the current and hence the steam generating ability is dependent on the voltage applied to the electrodes, the size, shape and spacing of the electrodes, the depth of immersion of the electrodes and the conductivity and volume of the water. A serious problem which has been recognized is that the conductivity of a water supply can vary by as much as 10:1 depending on the geological conditions of the source and also the conductivity of a particular water supply can vary daily in the same range (10:1) depending on variables such as interconnections in the water main and switching and/or mixing of the sources and the season of the year. Because the design of an evaporator is dependent on the conductivity of the water in the vessel, it is necessary to ensure that the conductivity of the water in the vessel is maintained near the value for which the evaporator was designed or else tedious adjustments or adaptations of the evaporator will be necessary to accommodate different water conductivities.

Furthermore, because of the continual evaporation of water from the vessel, impurities from the water remain in the vessel and increase in concentration to the point where flushing of the vessel is necessary to maintain the contained water conductivity at the designed value and to reduce mineral build-up on the electrodes. If flushing is carried out merely on a time basis, the water may be flushed when its conductivity is below the designed value. In any event, the loss of hot water from the system during flushing is likely to exceed that necessary to maintain the conductivity at the designed value.

U.S. Pat. No. 3,937,920 issued on Feb. 10, 1976 to Plascon A.G. discloses a system which deals with these problems by arranging for the conductivity of the water in the vessel to be maintained at a value which is considerably higher than the average conductivity of typical water sources. As water is boiled off, the conductivity in the vessel gradually rises to the optimum designed value.

The magnitude of the current between the electrodes is measured continuously and the actual time taken for the current to drop between two predetermined value is compared with the calculated time required for the current to drop between those two values when the conductivity of the water is at the designed value. If the actual time measured is shorter, some of the water is flushed from the vessel, as this represents an unacceptably high conductivity.

SUMMARY OF THE INVENTION

It is an object of the present invention to provide a novel method of operating a water-vapor generator to control the conductivity of the contained water and maintain the conductivity at the designed value.

It is another object of the present invention to provide a novel water-vapor generator adapted to control the conductivity of the contained water and maintain the conductivity at the designed value.

The present invention involves obtaining a measure of the frequency of two or more cycles, each cycle containing a boil and fill leg, and, if the measure of the frequency increases above a predetermined value corresponding to a desired, i.e. design, frequency, causing water to be discharged.

The frequency can be determined in various ways, such as by measuring the time to count a predetermined plurality of cycles, or by counting the number of cycles in a predetermined duration.

Alternatively, the frequency of the fill legs or the boil legs can be used as a measure of the cycle frequency in which case the time to measure a predetermined plurality of fill legs or boil legs is obtained or the number of fill legs or boil legs in a predetermined duration is counted.

As another alternative, the accummulated boil time over two or more cycles or the accumulated fill time over two or more cycles may be measured and this also would give a measure or indication of the cycle frequency.

The drain leg can be adjusted directly by time so that the higher the frequency measured the longer the drain leg. Alternatively, the drain leg can be arranged to continue until the current reaches a threshold value, the higher the frequency the lower the threshold value selected.

By concentrating on measuring the frequency of two or more cycles, the invention has the effect of minimizing the possibility of obtaining an incorrect indication of contained water conductivity which could arise due to spurious or transient factors and thereby minimizing the possibility of ordering a flush cycle needlessly.

Finally, a feedback control can be built in which has the effect of altering the requirements for a particular group of cycles depending upon the frequency measured for the immediately preceding group of cycles. Thus, the measured frequency is compared with a variable frequency which is weighed in relation to the frequency measured for the preceding group. In other words, if the frequency measured for the previous group of cycles was high, the predetermined frequency is decreased and if the frequency measured for the previous cycles was low, the predetermined frequency is increased. The effect of this is to stabilize the water level substantially at one point with respect to the electrodes whether the mains supply is of high or low conductivity.

BRIEF DESCRIPTION OF THE DRAWINGS

The invention will now be described in greater detail with reference to the accompanying drawings, in which.

DESCRIPTION OF PREFERRED EMBODIMENTS

Figures 1A, 1B:
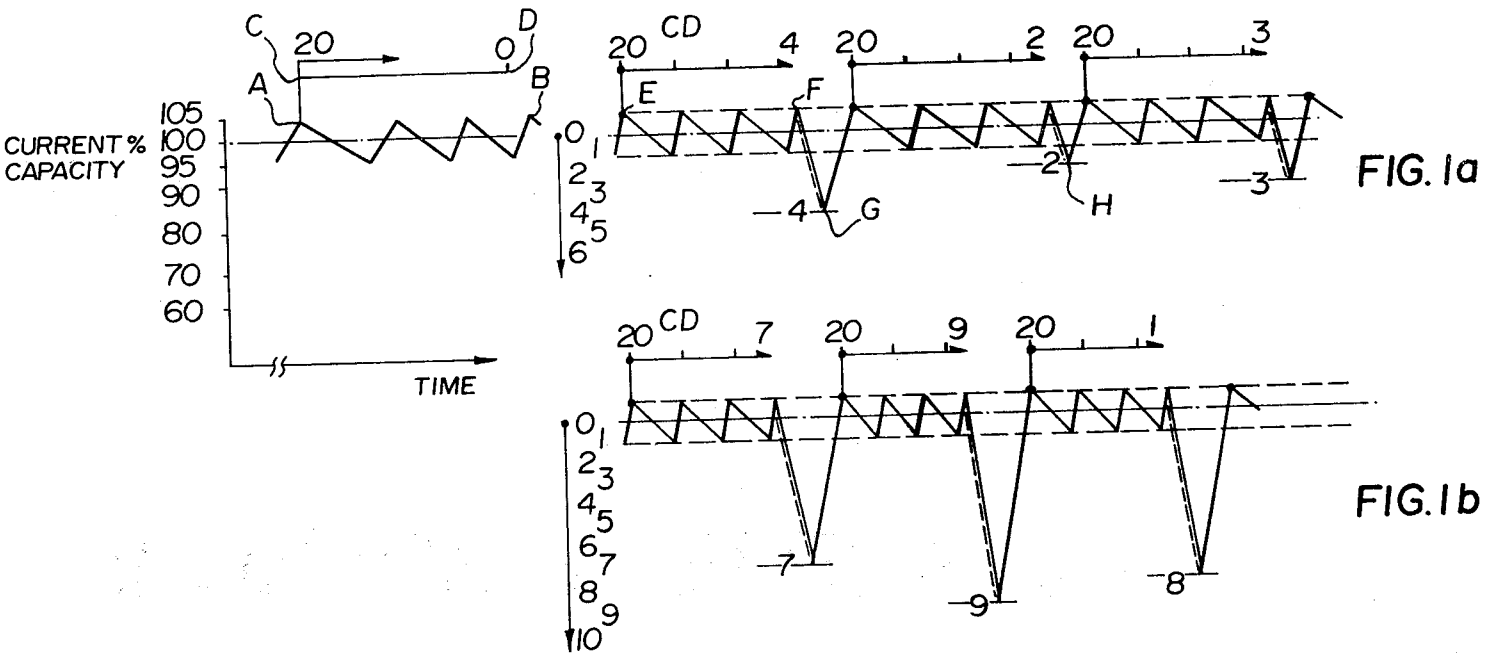
FIGS. 1A and 1B are diagrams illustrating the principles underlying the present invention.
Figure 2:
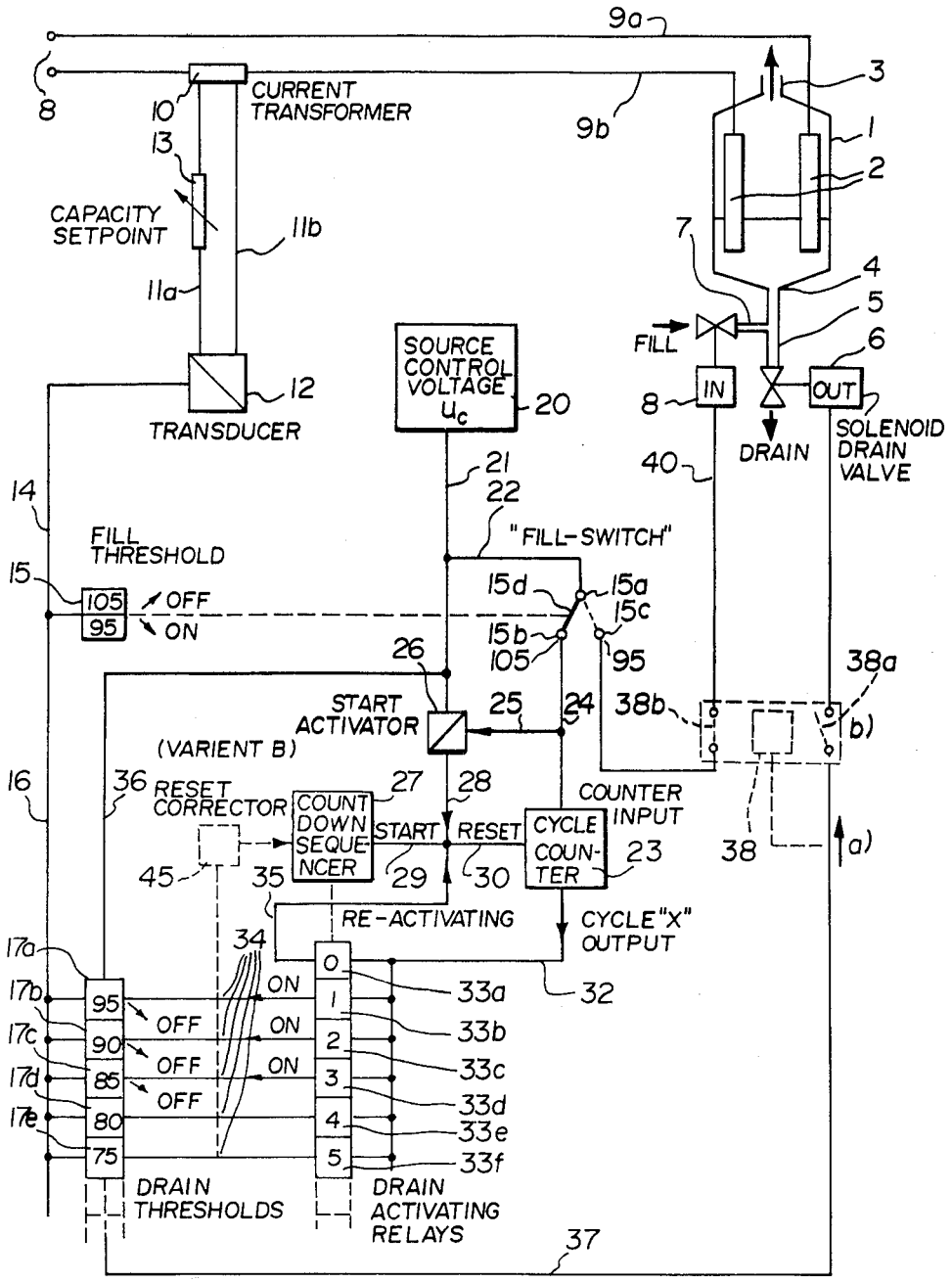
FIG. 2 is a schematic diagram illustrating an embodiment of the invention which applies the principles illustrated in FIG. 1.

It is believed that a better understanding of the circuit shown in FIG. 2 will be achieved after an explanation of the principles upon which the invention is based is given with reference to FIG. 1.

It should be appreciated that, as is well-known in the art, a vaporization container contains two or more electrodes which heat water in the container to boiling point and as water is boiled off and replenished with "fresh" mains water the concentration of minerals in the container water gradually increases causing a corresponding increase in the conductivity of the water. It is necessary to flush out some of the container water from time to time to maintain the water conductivity around the value for which the unit was designed. FIG. 1 explains how this may be accomplished according to the present invention.

With particular reference to FIG. 1*a* which is a plot of the electrode current, expressed as a percentage of the rated or designed value, against time, this shows fill, boil and drain cycles of the vaporization vessel.

When the container is originally filled from an empty condition the current level rises to a point (e.g. 5%) above the rated current at which point the water supply is cut off. As current at 105% continues to flow the water heats to boiling point and starts boiling off as steam to be used in air conditioning. As the water level falls due to the loss of water steam, the current falls until it reaches 95% of the rated value at which point mains replenishing water is fed to the container and the current rises once more to the 105% at which point the supply of water is cut off and the boil/fill cycle is repeated. Because the conductivity of the water is increasing gradually with every cycle, it takes less water to again reach 105%, and less water needs to be boiled away to drop to 95%. Therefore, the cycling rate or frequency of cycling increases gradually and this observation is used as the basis of the present invention.

The point A represents the end of a fill portion of a cycle near start-up of the whole operation, i.e. before the container water has become very concentrated. It could, in fact, be the end of the very first fill leg beginning from empty. From the point A the next three (for example) complete boil/fill cycles are counted and this occurs at point B. The design frequency, i.e. the frequency which would occur if the contained water conductivity were at the desired or designed value, can be established theoretically or experimentally and this would give a duration C-D for three complete cycles. If the measured frequency of the three cycles from A-B differs from the design frequency it can be determined whether the conductivity is too high or too low. In the case shown, the first three cycles from A-B last longer than C-D, i.e. the measured frequency is less than the design frequency, for three complete cycles assuming the water is at the desired conductivity. This means that the water conductivity is less than the desired value and no drain cycle is initiated.

The end of the very next fill portion at which the 105% current level is reached is designated E and the next three complete boil/fill cycles ending at point F are counted and it is noted that the frequency from E-F is greater than the design frequency indicated by C-D corresponding to the desired conductivity. In fact, the three cycles have elapsed some 4 units before C-D and so at point F a drain cycle is initiated to flush out some of the concentrated water. The drain cycle continues to the point G at which the electrode current is a predetermined percentage of the rated current, e.g. 80%. The length of the drain cycle depends on how much greater the actual frequency is than the design frequency. If the actual frequency is very high, this indicates that the water conductivity is very high and so the drain cycle should be correspondingly long. The drain cycle may be arranged to last a time proportional to the difference between the actual frequency and the design frequency or, as is preferred, the drain cycle is arranged so that it shuts off when a predetermined value of current is reached this value being proportional to the frequency difference. Thus, the point G at which the drain cycle ceases corresponds to 80% current, the point H (which is the drain shut-off point after the next three cycles) corrsponds to 90% current and so on.

FIG. 1*a* has been drawn for the case where the conductivity of the replenishing water is low and FIG. 1*b* represents the case where the replenishing water is much higher in conductivity. It can be seen that the predetermined number of cycles is counted much more quickly, i.e. the actual frequency is much higher, and correspondingly lower values of current are reached before the drain cycles are ceased in the case of FIG. 1*b*.

Apparatus for carrying out the principles described above in relation to FIG. 1 will now be described with reference to FIG. 2 which is a schematic diagram of an embodiment of the invention.

A vaporization container or vessel 1, constructed of a noncorrosive and non-conductive material contains a plurality (two in the embodiment shown) of electrodes 2. The electrodes may be concentric cylindrical tubes or spaced plates and in the embodiment shown are spaced plates vertically disposed and of constant cross-section throughout their height. The electrodes are constructed of a non-corrosive electrically conductive material.

The vessel 1 has an opening 3 at the top thereof for communication with a steam-carrying conduit (not shown) for conveying steam to a space the moisture content or humidity of which is to be controlled.

The vessel 1 has an opening at its bottom, the opening communicating by means of a pipe 5 with a drain valve (solenoid operated in this embodiment) 6. A branch pipe 7 connects opening 4 to a solenoid operated fill valve 8 for supplying replenishing mains water to the vessel.

The electrodes 2 are connected to an electrical supply source 8 by means of lead wires 9*a* and 9*b*. In line 9*b* a current sensing means, typically a current transformer 10 or an electrical resistor, is provided. The transformer outputs are connected by lead wires 11*a* and 11*b* to a transducer 12 which processes the signals from the current transformer into control signals proportional to the electrode current. The current transformer and transducer together form a measuring device for the current passing between the electrodes. A manual or automatically adjusting variable resistor 13 is provided in line 11*a* so as to permit regulation of the magnitude of the control signal.

The output of the transducer 12 is connected via lead 14 to a fill threshold switch 15 which contains a changeover switch having three contacts 15*a*, 15*b* and 15*c* and a movable contact 15*a* which is movable from the position shown in the solid line to the position shown in the broken line. The threshold switch 15 is constructed so that the movable contact 15*d* moves to the position shown in solid when the control signal reaches or exceeds a predetermined maximum value fixed in the threshold switch and switches back to the broken line position when the control signal drops to or below a predetermined minimum value fixed in the threshold switch. The value of the control signal is determined by the setting of variable resistor 13 and corresponds to the value of the current which should flow through the electrodes 2 and thus is also a measure of the value of the vaporizing capacity. Since the relationship between the electrode current and the magnitude of the control signal can be set by adjusting the variable resistor 13, the response values of the threshold switch 15 can be adjusted over a wide capacity range of the vaporizer. Whatever the actual current values chosen, typically the maximum and minimum values at which the threshold switches cause changeover of contact 15*d* represent, respectively, 105% and 95% of the rated or designed current value.

The output of transducer 12 is also connected through lead wire 16, an extension of lead 14, to drain thresholds 17*a*–17*e* which are, respectively, fixed to turn off when the control signal drops below a value corresponding to 95%, 90%, 85%, 80%, 75% of the rated electrode current. Of course, additional drain thresholds going down to 40% or so, as necessary, would also be incorporated in the circuit but it is unnecessary to show all of these.

A control voltage source 20 is connected via a line 21,22 to contact 15*a* of the changeover switch. Contact 15*b* is connected to a cycle counter 23 via line 24 which branches via line 25 to a start activator 26 which is also connected directly via line 21 to voltage source 20. The start actuator output is connected to the start input of a count down sequencer 27 via lines 28 and 29 and to the reset input of cycle counter 23 via lines 28 and 30. The cycle counter 23 has an output which is connected via line 32 to a series of switches 33*a*–33*f* of which switches 33*b*–33*f* correspond, respectively to drain thresholds 17*a*–17*e* and are shown connected via lines 34. An output line 35 from switch 33*a* is connected back to the start input of sequencer 27 and the reset input of counter 23.

Although switches 33 and thresholds 17 are shown separately, they may be combined as relays each when energised vai line 32 passing a drain opening signal when the predetermined threshold is reached. Accordingly, hereinafter switches 33 will be referred to as relays and it will be understood that thresholds 17 are not separate physical elements but represent preset thresholds of the relays.

A line 36 is connected from line 21 to the relays 33 (shown connected to drain thresholds 17) and an output line 37 is connected from the relays 22 (shown connected to the drain thresholds 17*a*–17*e*) to a relay 38 which has a normally open contact arranged 38*a* in the line 37 between the drain thresholds and the solenoid drain valve 6. Relay 38 also has a normally closed contact 38*b* arranged in a line 40 which connects contact 15*c* of the changeover switch to solenoid fill valve 8.

The count down sequencer 27 is arranged to step through relays 33*n* to 33*a* in that order as it counts down from the preset value, for example 20.

The circuit of FIG. 2 operates as follows. Initially solenoid fill valve 8 is open to fill or partially fill the vessel 1. When the current passing between electrodes 2 reaches the 105% value as monitored by the current measuring device (current transformer 10 and transducer 13) the threshold switch 15 causes the changeover switch to move to the position shown in full from the broken line position thus immediately closing the fill valve.

The switching over of the changeover switch causes line 24 and cycle counter 23 to be energized by voltage source 20 and this is seen by cycle counter 23 as the start of a cycle. At the same time the count down sequencer 27 is started and begins to step through the relays 33.

When the current value reaches 95% due to boiling off of some of the water in vessel 1 the fill threshold switch 15 changes the changeover switch back to the broken line position and fill valve 8 opens again to replenish the vessel with mains water. Again the 105% value is reached and the changeover switch reverts to the solid line position signalling to cycle counter 23 one complete cycle. This is repeated until the cycle counter 23 has counted a predetermined number of cycles set in the cycle counter at which point an output signal is generated by the cycle counter 23 and appears on line 32.

If the count down sequencer has previously completed counting to zero the relays 33 will have been stepped down to 33*a* and the cycle counter 23 will simply be switched through relay 33*a* to line 35 to reset the cycle counter 23 and restart the count down timer 27. This corrsponds to point B on FIG. 1*a*.

If the count down sequencer 27 has not run out but is currently switched on to one of relays 33*b*–33*n* at the time the cycle counter output signal is derived, this signal energises that relay which causes a signal to pass from voltage source 20 to relay 38. This corresponds to point F on FIG. 1*a*. For example, if relay 33*e* is currently opened by count down sequencer 27, the cycle counter output signal energises this relay (thus energising from voltage source 20 relay 38) until the current value drops to 80%. It can be seen from FIG. 1*a* that this current value corresponds to the step (4) to which the sequencer has progressed. The energising of relay 38 causes contact 38*a* to close thus activating drain valve 6 and causing water to drain from vessel 1. At the same time contact 38*b* is opened thus presenting an energising signal to reach solenoid fill valve 8 which would occur when the current dropped to the 95% value set in the threshold switch 15. Thus, the fill valve is prevented from being open while the drain valve is open. In certain cases it may be considered advantageous to allow replenishing water to be mixed in while the drain valve is open and to achieve that, relay 38 could be dispensed with so that when the current valve dropped to 95% the fill threshold switch 15 would energise the fill valve 8. Alternatively, relay 38 could be adapted by replacing normally closed contact 38*b* with a normally open contact connected directly between voltage source 20 and fill solenoid valve 8 so that as soon as drain valve 6 was opened the fill valve would also open.

When the current passing between electrodes 2 drops to 80% threshold 17*d* cuts off drain valve and recloses contact 38*b* allowing fill valve 8 to open. This corresponds to point G on FIG. 1*a*. When the vessel is refilled the same sequence of steps is repeated. The cycle counter 23 is reset and count down sequencer 27 restarted when the changeover switch moves once more to the full line position.

Figures 3A, 3B:
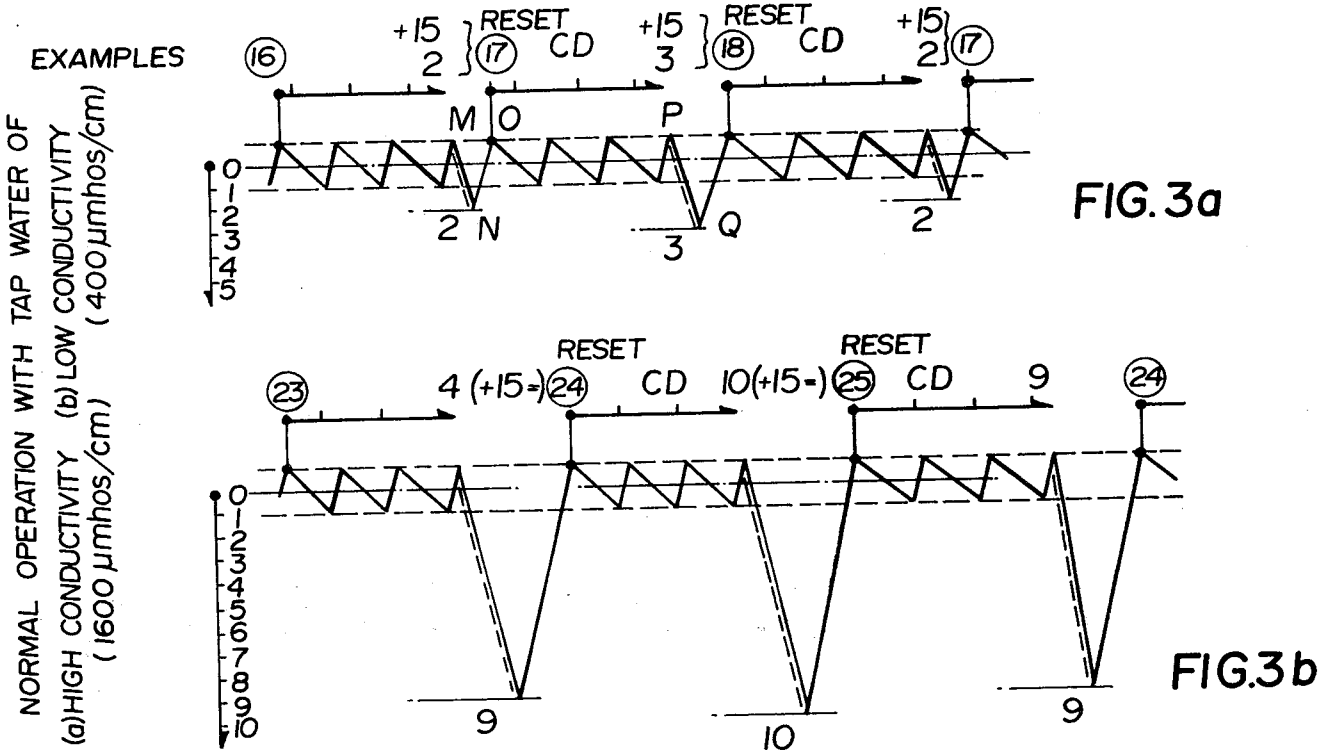
FIGS. 3A and 3B are diagrams illustrating a modification of the basic technique illustrated in FIG. 1.

FIG. 3 illustrates a modification of the basic techniques described with reference to FIG. 1. Here the value to which the count down sequencer 27 is reset depends upon the duration of the previous three cycles. FIG. 3*a* illustrates the case where the mains water is of low conductivity and FIG. 3*b* where the mains water is of high conductivity. Looking at the first three cycles of FIG. 3*a*, it can be seen that 2 units remain on the count down sequencer after three cycles have been connected. As before the drain cycle is carried out over portion M-N until a threshold current value corresponding to the step to which the sequencer has progressed is reached. At the end of the fill cycle N-O the count down sequencer is reset by adding a predetermined number of steps to the steps left on the sequencer at point M. Thus, for the next three cycles, i.e. O-P the count down sequencer counts down from 2+15=17.

When the point P is reached there are still 3 steps remaining in the count down sequencer and the drain cycle P-Q corresponds to this value. Also, 15 steps are added to this value to provide the new reset quantity of 18 steps to the count down sequencer for the next three cycles and so on.

As can be seen by comparing FIGS. 3*a* and 3*b*, when the water conductivity is very high and cycling is correspondingly fast, the drain cycles are longer as was the case with the basic system of FIGS. 1*a* and 1*b*. As can be seen by comparing FIGS. 3*b* and 1*b* the drain cycles are longer in FIG. 3*b* due to the weighting of the reset quantity of the count down sequencer. The effect of this weighting in practical terms can be appreciated by comparing FIGS. 4*a* and 4*b*.

Figures 4A, 4B:
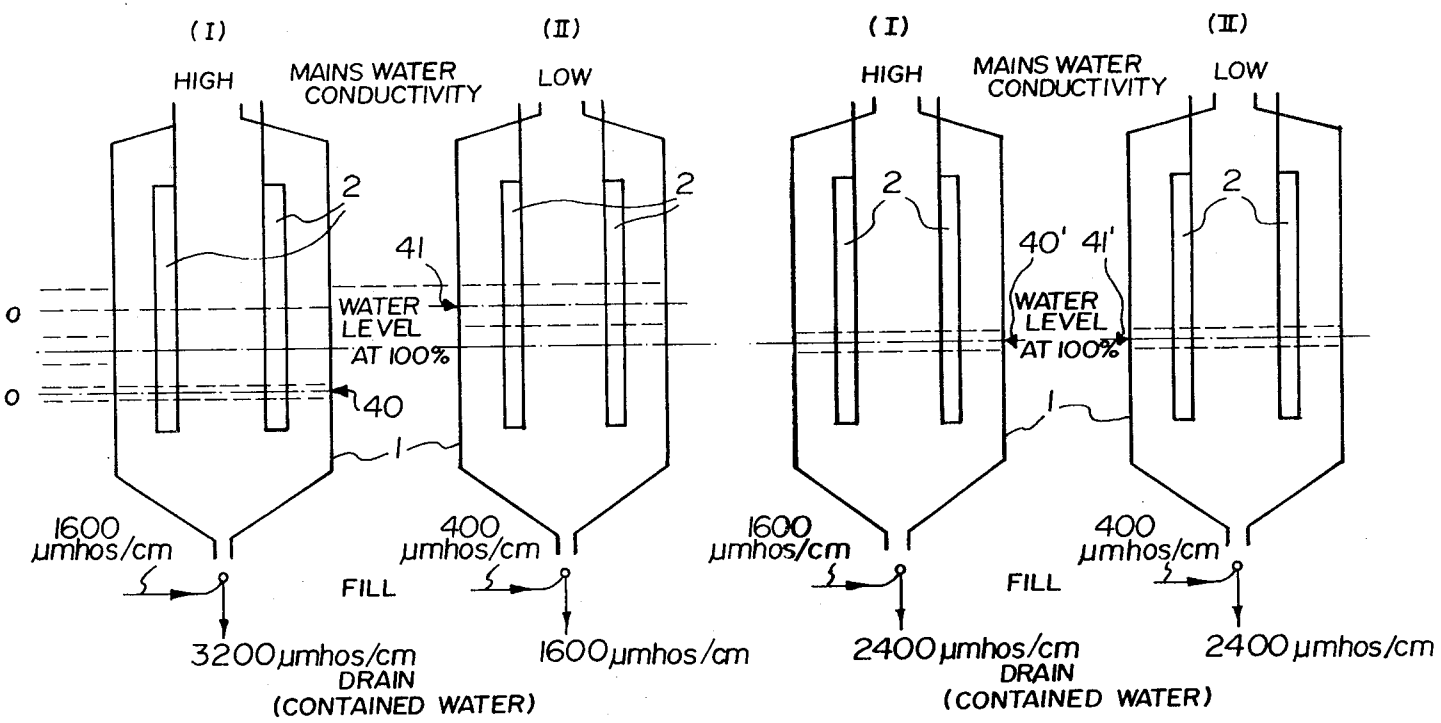
FIGS. 4A and 4B illustrate diagramatically the difference in outcome between applying the principles of FIG. 1 on the one hand and FIG. 3 on the other hand.

FIG. 4*a* illustrates diagrammatically the difference in water levels inside the vessel for mains water of high conductivity (I) and for mains water of low conductivity (II) using a fixed number of count down steps as explained with reference to FIG. 1 and FIGS. 4*b*(I) and 4*b*(II) illustrate the same thing but using a "weighted" number of count down steps. In FIGS. 4*a*(I) and 4*a*(II) reference numeral 40 indicates the water level in the high conductivity case at which the current is 100% of designed value and the same current value is achieved at water level 41 when the conductivity is low. It can be seen that there is a considerable difference in these levels. Because the water level varies considerably over the range of water conductivities which would be expected from different water supplies it is not possible to design the vessel so that when it is new the water level for a predetermined current value is established just above the lower ends of the electrodes 2 for all values of water conductivity.

With reference now to FIG. 4*b*, it can be seen that by "weighting" the number of count down steps, the levels 40′ and 41′, representing the high conductivity and low conductivity levels, respectively, for 100% current are virtually identical and so the vessel can be designed so that this level is near the bottom of the electrodes 2. This is desirable because in this way, the bottom of the electrodes is used first and as this becomes encrusted with deposits the level moves up bringing into use fresh surface portions of the electrodes. Moreover, a low water level means that the current is passed between a small surface area of the electrodes and the relatively high current density enables great penetration of the build-up of deposits on the electrodes. Thus, the deposits can build-up to a considerable thickness before the current flow is seriously curtailed which means a longer cylinder life.

In order to achieve the "weighting" of the count down time in practice a reset corrector 45 shown in phantom in FIG. 2 is provided. This has an input connected to relays 33 and an output connected to count down timer 27. Reset corrector operates to add to a fixed value (e.g. 15 minutes) in the count down timer 27 the value in minutes corresponding to the relay 33 which has previously been stepped by the count down timer 27 while the cycle counter gave out its output signal. For example, if relay 33*e* were energised, the correction value may be 4 minutes so that the count down timer would be reset at 4+15=19 minutes.

Figure 5:
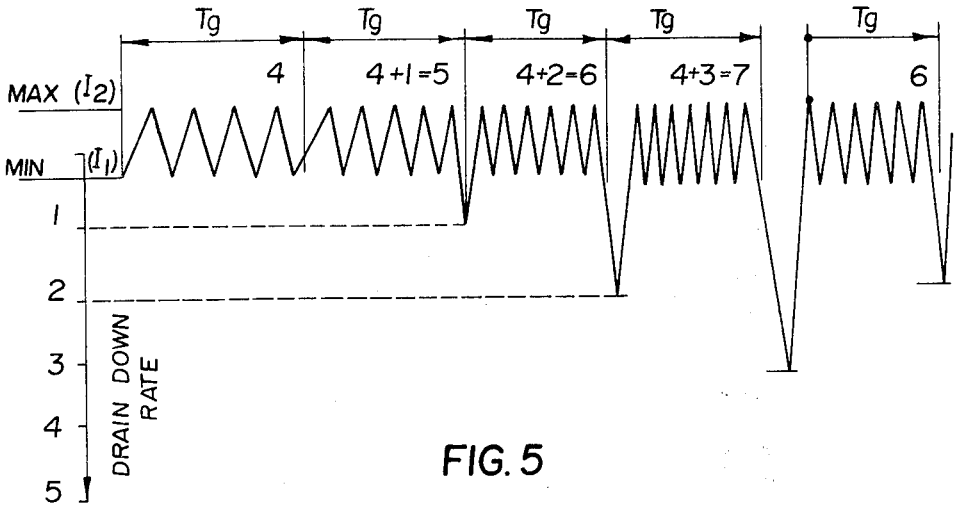
FIG. 5 is a diagram illustrating a variant of the basic technique shown in FIG. 1.

FIG. 5 illustrates a variant of the technique shown in FIG. 1. Here, instead of counting up to a predetermined number of cycles, e.g. 3, and relating to whether or not the predetermined time has expired, the total number of cycles in a predetermined time interval is counted and compared to the number of cycles that would occur in that same time if contained water was at design conductivity. Thus in the first interval Tg, four cycles are counted and this number has been previously determined as the correct number in the particular time period to give the required conductivity level. As the conductivity increases, five cycles are counted in the next interval Tg and a drain cycle is initiated, the extent of the drain cycle depending on the number of counted cycles by which the predetermined number, namely 4, is exceeded. In the third interval Tg shown, the number of cycles counted is 6 and the drain cycle is correspondingly longer. Again, the length of the drain cycle can be made time dependent or can be determined by a current threshold.

It can be seen that the technique illustrated in FIG. 5 is another way of comparing the actual frequency with the design frequency of the cycles.

Figure 6:
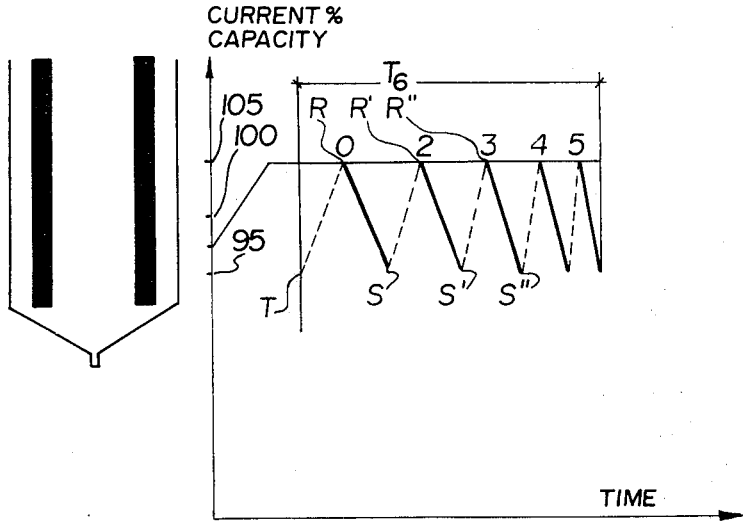
FIG. 6 is a diagram illustrating a further variant of the basic technique shown in FIG. 1.

FIG. 6 illustrates a variant of the basic technique shown in FIG. 3. Here, instead of measuring the frequency of complete cycles, we measure the frequency of occurrence of a particular leg of the cycles, e.g. the boil leg or the fill leg. Thus, the boil legs RS, R′S′, R″S″ etc. or fill legs TR, SR′, S′R″ etc. are counted in the predetermined duration Tg. As the number of boil legs (or fill legs) is the same as the number of cycles, again we are comparing the actual frequency of the cycles with the design frequency.

Of course, instead of counting the number of boil legs or fill legs in a predetermined time we could, in a manner analagous to the technique shown in FIG. 1, keep the number of cycles (i.e. number of boil legs or fill legs) constant and relate this to whether or not the predetermined duration has expired. This, again amounts to comparing the actual frequency of the cycles with the design frequency.

As another variation of the basic technique, instead of counting the number of boil legs or fill legs in a predetermined duration Tg, the actual accumulated duration of all the boil legs (or fill legs as the case may be) could be obtained as a measure of the cycle frequency (The accumulated time is, of course, inversely proportional to the frequency). This then would be compared with a value corresponding to the accumulated boil (or fill) time which would be expected for a design frequency.

It will be understood that this invention is capable of a variety of modifications and variations which will become apparent to those skilled in the art upon a reading of the specification, such modifications intended to be part of the invention as defined in the appended claims. For example, it should be apparent that the apparatus shown in FIG. 2 is merely exemplary and that the invention could be realised by electronic or fully integrated microprocessor circuitry instead of the electromechanical circuitry shown.

What we claim as our invention is:

1. A method of operating a water-vapor generator comprising a vaporization vessel containing water and having electrodes which are connected to a power supply between which flows a current the magnitude of which depends on the depth of immersion of the electrodes in the water in the vessel and the conductivity of the water, the method comprising continuously measuring the magnitude of the electrode current, filling the vessel with water to an extent to give a predetermined maximum electrode current, allowing water in the vessel to boil off until a predetermined minimum electrode current is achieved, re-filling the vessel to obtain again the predetermined maximum electrode current and repeating the boiling and filling steps to provide a plurality of cycles each containing a boil leg and a fill leg, obtaining a measure of the frequency of each of successive pluralities of cycles which corresponds to the actual conductivity of the water and comparing the measure obtained with a predetermined frequency value which corresponds to a desired conductivity of the water, and if the measured frequency is greater than the predetermined frequency, automatically discharging from the vessel a quantity of water which is directly proportional to the amount by which the measured frequency exceeds the predetermined frequency, whereby said quantity of water discharged is directly proportional to the difference between the actual conductivity and desired conductivity of the water.

2. A method according to claim 1, in which the measure of the frequency is obtained by counting the cycles and measuring the time taken to count a predetermined number of cycles, a quantity of water being discharged if the time taken is less than a predetermined time for the predetermined number of cycles.

3. A method according to claim 1, in which the water is discharged from the vessel until a selected one of a predetermined plurality of low current thresholds is achieved by the current passing between the electrodes, the greater the measured frequency exceeds the predetermined frequency the lower the particular low current threshold selected.

4. A method according to claim 2 in which the water is discharged from the vessel until a selected one of a predetermined plurality of low current thresholds is achieved by the current passing between the electrodes, the shorter the time taken to count the predetermined number of cycles the lower the low current threshold selected.

5. A method according to claim 2, including varying the predetermined time for the predetermined number of cycles, the predetermined time for a particular group of cycles being increased above a fixed value in inverse proportion to the time measured for the immediately preceding predetermined number of cycles.

6. A method according to claim 5, in which the water is discharged from the vessel until a selected one of a predetermined plurality of low current thresholds is achieved by the current passing between the electrodes, the greater the amount by which the time taken to count the predetermined number of cycles is exceeded by the predetermined time in effect for that particular predetermined number of cycles the lower the low current threshold selected.

7. A method according to claim 1, in which the measure of the frequency is obtained by counting the cycles completed in a predetermined duration, a quantity of water being discharged if the number of cycles counted in the predetermined duration is greater than a predetermined 8. A method according to claim 7, in which the water is discharged from the vessel until a selected one of a predetermined plurality of low current thresholds is achieved by the current passing between the electrodes, the greater the number of cycles counted the lower the low current threshold selected.

9. A method according to claim 1, in which the measure of the frequency is obtained by measuring the time of the boil legs of the cycles and adding the total boil time over a predetermined interval, a quantity of water being discharged if the total boil time is less than a predetermined total accumulated boil time for the predetermined interval.

10. A method according to claim 9 in which the water is discharged from the vessel until a selected one of a predetermined plurality of low current thresholds is achieved by the current passing through the electrodes, the less the total boil time measured the lower the low current threshold selected.

11. A method according to claim 1, in which the measure of the frequency is obtained by measuring the time of the fill legs of the cycles and adding the total fill time over a predetermined interval, a quantity of water being discharged if the total fill time is less than a predetermined accumulated total fill time for the predetermined interval.

12. A method according to claim 11 in which the water is discharged from the vessel until a selected one of a predetermined plurality of low current thresholds is achieved by the current passing through the electrodes, the less the total fill time measured the lower the low current threshold selected.

13. A method according to claim 1, in which the measure of the frequency is obtained by counting the number of boil legs completed in a predetermined duration, a quantity of water being discharged if the number of boil legs counted in the predetermined duration is greater than a predetermined number.

14. A method according to claim 13, in which the water is discharged from the vessel until a selected one of a predetermined plurality of low current thresholds is achieved by the current passing through the electrodes, the greater the number of boil legs counted the lower the low current threshold selected.

15. A method according to claim 1, in which the measure of the frequency is obtained by counting the boil legs and measuring the time taken to count a predetermined number of boil legs, a quantity of water being discharged if the time taken is less than a predetermined time for the predetermined number of cycles.

16. A method according to claim 15 in which the water is discharged from the vessel until a selected one of a predetermined plurality of low current thresholds is achieved by the current passing through the electrodes, the shorter the time taken to count the predetermined number of boil legs the lower the low current threshold selected.

17. A method according to claim 1, in which the measure of the frequency is obtained by counting the number of fill legs completed in a predetermined duration, a quantity of water being discharged if the number of fill legs counted in the predetermined duration is greater than a predetermined number.

18. A method according to claim 17, in which the water is discharged from the vessel until a selected one of a predetermined plurality of low current thresholds is achieved by the current passing through the electrodes, the greater the number of fill legs counted the lower the low current threshold selected.

19. A method according to claim 1, in which the measure of the frequency is obtained by counting the fill legs and measuring the time taken to count a predetermined number of fill legs, a quantity of water being discharged if the time taken is less than a predetermined time for the predetermined number of cycles.

20. A method according to claim 19 in which the water is discharged from the vessel until a selected one of a predetermined plurality of low current thresholds is achieved by the current passing through the electrodes, the shorter the time taken to count the predetermined number of fill legs the lower the low current threshold selected.

21. A water-vapor generator comprising a vaporization vessel provided with electrodes and with an inlet for fresh water and an outlet for discharging water in order to reduce the concentration of minerals an inlet valve arranged to control the flow of water through the inlet, an outlet valve arranged to control the flow of water through the outlet, means for measuring continuously the current flowing through the electrodes, threshold means connected to the current measuring means and operable to open the inlet valve when the measure current reaches a predetermined minimum value and to close the inlet valve when the measured current reaches a predetermined maximum value, means connected to the threshold means for obtaining a measure of the frequency of successive pluralities of cycles each containing a leg descending from the predetermined maximum value to the predetermined minimum value and the subsequent leg ascending from the predetermined minimum value to the predetermined maximum value, means for comparing the frequency measure obtained which corresponds to the actual conductivity of the water with a predetermined frequency value corresponding to a desired conductivity of the water, and a control device connected to be controlled by the comparison means to open the outlet valve when the measured frequency is greater than the predetermined frequency and cause the outlet valve to remain open for a time interval which is directly proportional to the amount by which the measured frequency exceeds the predetermined frequency, whereby the amount of water discharged is directly proportional to the difference between the actual conductivity and desired conductivity of the water.

22. A water-vapor generator comprising a vaporization vessel provided with electrodes and with an inlet for fresh water and an outlet for discharging water in order to reduce the concentration of minerals, an inlet valve arranged to control the flow of water through the inlet, an outlet valve arranged to control the flow of water through the outlet, means for measuring continuously the current flowing between the electrodes, threshold means connected to the current measuring means and operable to open the inlet valve when the measured current reaches a predetermined minimum value and to close the inlet valve when the measured current reaches a predetermined maximum valve, means connected to the threshold means for counting successive pluralities of cycles each containing a leg descending from the predetermined maximum value to the predetermined minimum value and the subsequent leg ascending from the predetermined minimum value to the predetermined maximum value, means for measuring the duration of a predetermined number of cycles which corresponds to the actual conductivity of the water and for comparing the duration with a predetermined duration which corresponds to a desired conductivity of the water and a control device connected to the outlet valve and operable under control of the measuring and comparing means to open the outlet valve when the actual duration is less than the predetermined duration and to cause the outlet valve to remain open for a time interval which is directly proportional to the amount by which the predetermined duration exceeds the actual duration, whereby the amount of water discharged is directly proportional to the difference between the actual conductivity and desired conductivity of the water.

23. A water-vapor generator according to claim 22 wherein the measuring and comparing means comprises a count down sequencer in which the predetermined duration is set, the count down sequencer being arranged to step down through a plurality of switch means connected to the control device and wherein the means for counting cycles has an output connected to the plurality of switch means, an energising signal being obtained at the output of the means for counting cycles when the predetermined number of cycles has been counted whereby the energising signal passes through one of the plurality of switch means to the control device when the count down sequencer has not finished counting down to the predetermined duration.

24. A water-vapor generator according to claim 23 wherein the plurality of switch means comprises a plurality of relays connected to the means for measuring continuously the current flowing through the electrodes, the relays having ascending energising threshold values in direct relation to the order in which the count down sequencer counts down through the relays, whereby a relay energised will remain energised until the electrode current drops below the respective threshold value.

25. A water-vapor generator according to claim 24 including a reset corrector connected to the relays and to a reset input of the count down sequencer, the reset corrector being operable to increase the predetermined duration set into the count down sequencer after the count down sequencer has counted out, the amount by which the reset corrector increases the predetermined duration depending upon which of the pluralities of relays was immediately previously energised, the amount decreasing in direct relation to the order in which the count down sequencer counts through the relays.

26. A water-vapor generator comprising a vaporization vessel provided with electrodes and with an inlet for fresh water and an outlet for discharging water in order to reduce the concentration of minerals an inlet valve arranged to control the flow of water through the inlet, an outlet valve arranged to control the flow of water through the outlet, means for measuring continuously the current flowing through the electrodes, threshold means connected to the current measuring means and operable to open the inlet valve when the measured current reaches a predetermined minimum value and to close the inlet valve when the measured current reaches a predetermined maximum value, means for counting successively the number of cycles during a predetermined duration, each cycle containing a leg descending from the predetermined maximum value and a leg ascending from the predetermined minimum value, means for comparing the number of cycles counted which corresponds to the actual conductivity of the water with a predetermined number of cycles which corresponds to a desired conductivity of the water and a control device connected to the outlet valve and operable under control of the means for comparing so as to open the outlet valve when the number counted is greater than the predetermined number and cause the outlet valve to remain open for a duration which is directly proportional to the amount by which the number counted exceeds the predetermined number, whereby the amount of water discharged is directly proportional to the difference between the actual conductivity and desired conductivity of the water.

* * * * *